United States Patent [19]

Moody

[11] 4,080,603

[45] Mar. 21, 1978

[54] TRANSMITTING AND RECEIVING LOOP ANTENNA WITH REACTIVE LOADING

[76] Inventor: Howard Belmont Moody, 657 N. 21st St., Newark, Ohio 43055

[21] Appl. No.: 704,251

[22] Filed: Jul. 12, 1976

[51] Int. Cl.[2] ..... H01Q 1/32

[52] U.S. Cl. ..... 343/712; 343/744; 343/752

[58] Field of Search ..... 343/744, 752, 845, 846, 343/712

[56] References Cited

U.S. PATENT DOCUMENTS

| | | | |
|---|---|---|---|
| 3,151,328 | 9/1964 | Boyer | 343/742 |
| 3,375,525 | 3/1968 | Fisk et al. | 343/806 |
| 3,696,431 | 10/1972 | Holland | 343/743 |

*Primary Examiner*—Eli Lieberman

*Attorney, Agent, or Firm*—Marvin Reich

[57] ABSTRACT

The disclosure relates to an antenna system for C.B. radio use which is mounted upon a metallic base, such as the roof of an automobile, the antenna having the S-shape or Greek-key design configuration, the antenna being mounted at one end of the base through an insulating medium, the one end being coupled to a plate on the insulating medium which forms a capacitor with the insulating medium and the metallic base of fixed predetermined value. A variable capacitor is also formed between end extension of the plate and the free end of the antenna.

6 Claims, 4 Drawing Figures

Fig. 1
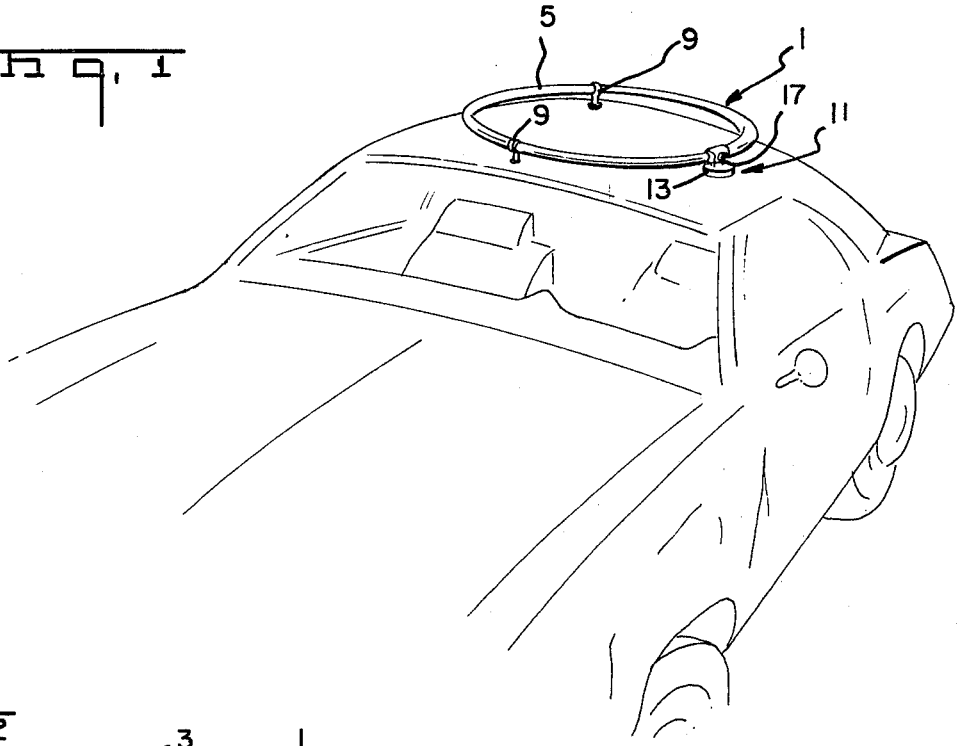
Fig. 2
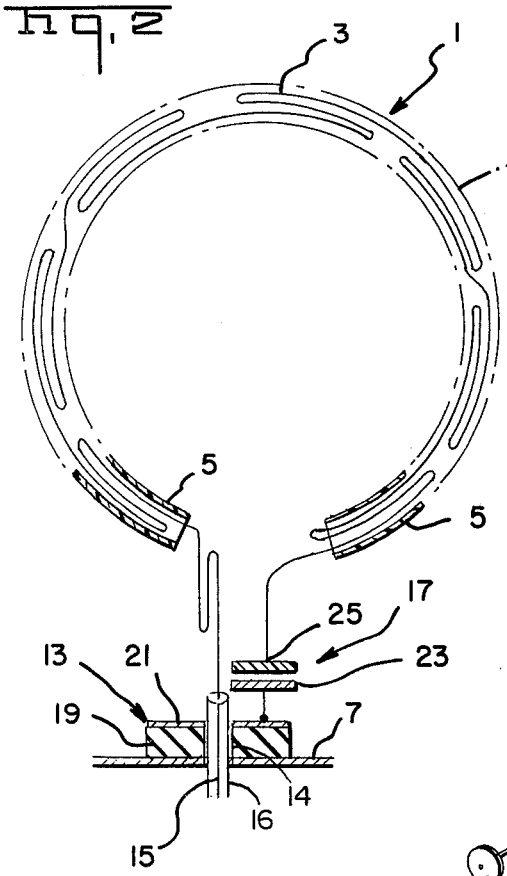
Fig. 3
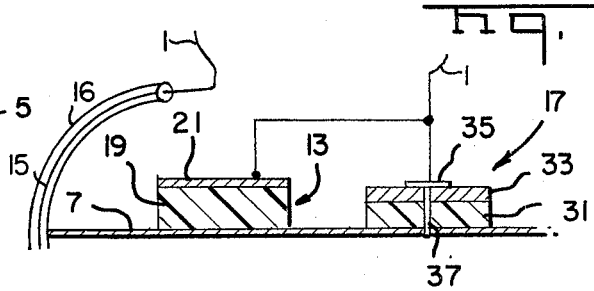
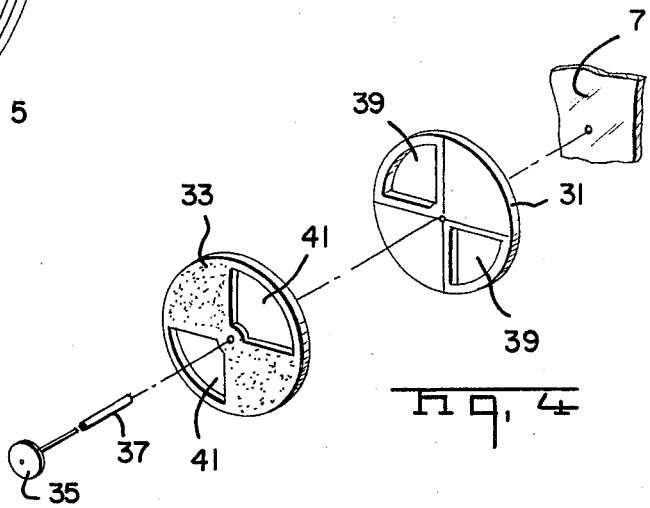
Fig. 4

TRANSMITTING AND RECEIVING LOOP ANTENNA WITH REACTIVE LOADING

BACKGROUND OF THE INVENTION

This invention relates to transmitter and receiving antennas, primarily for use in the citizen's band (C.B.).

Antennas for use with C.B. equipment, when mounted upon metallic, electrically conductive surfaces, such as the roof of an automobile, have not had flat response across the C.B. range. For example, an antenna of the type set forth in U.S. Pat. No. 3,689,929 was mounted upon an automobile and was found to have a very high Q and, as a result, a relatively high standing wave ratio (SWR) across the C.B. range from channels 1 to 23. A helical antenna mounted upon an automobile was also not flat across the citizen's band.

BRIEF DESCRIPTION OF THE INVENTION

An S-pattern antenna was then used and found to have a low SWR across the citizen's band; however, the resonance frequency was found to be a function of the metallic, electrically conductive surface area on which the antenna was mounted. The antenna was properly loaded by using a capacitor coupling plate for mounting same with formation of a predetermined capacitance (360 pf for a 20 inch diameter antenna). However, the resonant frequency rose as the automobile size increased. A small size variable capacitor formed at the free end of the antenna was found to overcome this problem.

Briefly, therefore, the invention is an antenna system for C.B. radio use which is mounted upon a metallic base, such as the roof of an automobile, the antenna having the S-shape or Greek-key design configuration, the antenna being mounted at one end on the base through an insulating medium, the one end being coupled to a plate on the insulating medium which forms a capacitor with the insulating medium and the metallic base of fixed predetermined value. A variable capacitor is also formed between end extension of the plate and the free end of the antenna.

OBJECTS OF THE INVENTION

It is therefore an object of the invention to provide an antenna for use in the C.B. range which is mountable on an electrically conductive surface and provides substantially flat response.

It is a further object of the invention to provide an S-shaped circular antenna for mounting upon an automobile, wherein the capacitance between antenna and automobile is substantially neutralized to provide substantially flat response.

The above objects, and still further objects of the invention will immediately become apparent to those skilled in the art, after consideration of the following preferred embodiment thereof, which is provided by way of example and not by way of limitation, wherein:

FIG. 1 is a perspective view of the antenna system of the present invention mounted upon the roof of an automobile;

FIG. 2 is electrical diagram of the antenna system of FIG. 1;

FIG. 3 is a sectional view of the structure of the fixed and variable capacitors; and FIG. 4 is an exploded view of the variable capacitor.

Referring now to FIG. 1, there is shown a circularly shaped antenna 1 which is essentially an S-shaped wire antenna 3 (FIG. 2) mounted within a circular plastic tube 5. The antenna 1 is supported upon the roof of an automobile by supports 9 at least two points thereof and is supported at a further point 11, wherein a fixed capacitor 13 is formed between the end of the antenna coupled to coaxial line having inner conductor (FIGS. 2 and 3) 15 and an outer conductive sheath 16 coupled to car roof 7, and a variable capacitor 17 is formed between one plate of the fixed capacitor 13 and the other end of the antenna. The coaxial line passes through an aperture 14 in the capacitor 13.

The capacitor structure is better shown in FIGS. 2 to 4, wherein a dielectric material 19, such as a magnetic rubber, is positioned on the car roof 7 with an electrically conductive plate 21 mounted over the dielectric 19, the area of the plate 21 as well as the thickness and dielectric constant of the dielectric being such as to provide a predetermined fixed capacitance between antenna and car roof. In addition, a second electrically conductive plate 23 is electrically coupled to plate 21 and is adjustable to form a variable capacitor with the free end of the antenna 25 to provide fine adjustments of capacitance.

Referring now more specifically to FIG. 4, the preferred variable capacitor 17 is described in greater detail. The capacitor 17 includes a disc 33 of electrically conducting material with pre-shaped cut out regions 41 and an axial aperture. The disc 31 is an electrical insulator with cut out pre-shaped regions 39. The shaft 37 is of electrically insulating material, passes through axes of discs 31 and 33 and is anchored in the car roof 7. The head 35 of shaft 37 is integral with the shaft and is electrically conductive. Head 35 can have an electrically conductive layer over insulator or be a solid conductor secured to shaft 37. The capacitance of capacitor 17 is varied by rotating disc 33 relative to disc 31 to change the amount of insulation or dielectric between the electrically conducting portions of disc 33 and car roof 7.

The S-shaped antenna structure, wherein the antenna wire would cut a diameter drawn through the antenna at three points at the S locations on the circle provides increased capture of radio waves as compared with antennas such as described in Root U.S. Pat. No. 3,716,861. Further, the undulating type antenna of Root is continuous coil in nature, whereas the S-type is like a pie section, making it broader in band response than the undulating continuous coil type since there is less capacity in the coil structure.

The S-shaped antenna is one quarter wavelength and works against the flat metal surface as the other half of the antenna. The undulating antenna is one half wavelength and is polarized in the plane in which it lies, while the antenna of the present invention lies in a horizontal plane but radiates in a vertical plane.

The S-shaped antenna could be built in geometric configurations other than circular, i.e., square, triangle, etc. The antenna could be wire, printed circuit or the like.

Although the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. An antenna system which comprises:

a. an electrically conductive base surface, and b. an antenna mounted on said base surface, including:

c. an electrically insulating layer disposed on said base surface, d. an electrically conductive plate positioned on said insulating layer remote from said base surface to form a capacitor therewith, said antenna being coupled at one end to said plate, e. said antenna having a plurality of S-shaped regions disposed about its continuous perimeter, and f. means coupled to said base for providing a variable capacitance between said antenna and said base surface.

2. A system as set forth in claim 1, wherein said base surface is the exterior surface of an automobile.

3. A system as set forth in claim 2, wherein the perimeter of said antenna is substantially circular.

4. A system as set forth in claim 1, wherein said means coupled to said base includes said base surface, electrically insulating means having apertures therein positioned on said base surface, electrically conductive means coupled to said one end of said antenna and having apertures alinable with said apertures of said electrically insulating means, said electrically insulating means and electrically conductive means being rotatable relative to each other.

5. A system as set forth in claim 2 wherein said means coupled to said base includes said base surface, electrically insulating means having apertures therein positioned on said base surface, electrically conductive means coupled to said one end of said antenna and having apertures alinable with said apertures of said electrically insulating means, said electrically insulating means and electrically conductive means being rotatable relative to each other.

6. A system as set forth in claim 3, wherein said means coupled to said base includes said base surface, electrically insulating means having apertures therein positioned on said base surface, electrically conductive means coupled to said one end of said antenna and having apertures alinable with said apertures of said electrically insulating means, said electrically insulating means and electrically conductive means being rotatable relative to each other.

* * * * *